US007182205B2

(12) United States Patent
Pestone

(10) Patent No.: US 7,182,205 B2
(45) Date of Patent: Feb. 27, 2007

(54) MAGNET SWEEP

(75) Inventor: William J. Pestone, Cohasset, MA (US)

(73) Assignee: Lehigh Consumer Products Corporation, Macungie, PA (US)

( * ) Notice: Subject to any disclaimer, the term of this patent is extended or adjusted under 35 U.S.C. 154(b) by 0 days.

(21) Appl. No.: 10/783,541

(22) Filed: Feb. 20, 2004

(65) Prior Publication Data

US 2005/0104696 A1 May 19, 2005

Related U.S. Application Data

(60) Provisional application No. 60/448,751, filed on Feb. 20, 2003.

(51) Int. Cl.
*B03C 1/00* (2006.01)
*H01F 7/02* (2006.01)

(52) U.S. Cl. ..... 209/215; 335/285; 335/306; 294/65.5

(58) Field of Classification Search ..... 335/285, 335/302–306; 294/65.5; 209/215
See application file for complete search history.

(56) References Cited

U.S. PATENT DOCUMENTS

| | | | | |
|---|---|---|---|---|
| 3,646,492 | A * | 2/1972 | Westermann | 335/285 |
| 4,407,038 | A * | 10/1983 | Haase | 15/105 |
| 4,633,563 | A * | 1/1987 | Rykaczewski | 29/270 |
| 5,395,148 | A * | 3/1995 | Jameson et al. | 294/65.5 |
| 5,868,258 | A * | 2/1999 | Hubbard, Jr. | 209/215 |
| 5,945,901 | A * | 8/1999 | Coleman et al. | 335/285 |
| 6,056,339 | A * | 5/2000 | Berger | 294/65.5 |
| 6,669,024 | B2 * | 12/2003 | Ottens | 209/215 |
| 6,677,845 | B1 * | 1/2004 | Fader et al. | 335/285 |
| 6,677,846 | B2 * | 1/2004 | Snider | 335/302 |
| 2003/0209472 | A1 * | 11/2003 | Hsiao | 209/215 |

* cited by examiner

*Primary Examiner*—Ramon M. Barrera

(57) ABSTRACT

A device for attracting metal particles which comprises a longitudinal member having a first and second end and a first magnet connected to the first end. The first magnet has a surface. The device further includes a housing connected to the second end which is substantially perpendicular to the longitudinal member. The housing has a second magnet disposed therein. A plate having a surface area is secured to the housing and is positioned within a proximity to the second magnet such that the plate is capable of attracting metal pieces thereto. The surface area of the plate has a substantially larger square area than the surface of the first magnet.

20 Claims, 7 Drawing Sheets

MAGNET SWEEP

PRIORITY DATA

This application claims the benefit of U.S. Provisional Application Ser. No. 60/448,751, filed on Feb. 20, 2003, and is hereby incorporated by reference.

BACKGROUND OF THE INVENTION

The present invention relates to devices for attracting metal pieces present on a surface.

The surface areas of industrial and educational work spaces require regular maintenance. For example, machining of a metal workpiece in an industrial work space creates metal chips that litter the surface of the work space. The chips must then be removed from the surface to maintain the industrial work space. Frequently, the chips litter the surface of the work space that lies between a wall of the industrial work space and the side wall of a structure (e.g., a machine) present in the industrial work space. Chips littering such tough to reach surfaces hamper the efficient removal of the chips from the surface. The device of the present invention addresses this problem.

BRIEF SUMMARY OF THE INVENTION

The invention is directed to a magnet sweep comprising a longitudinal member having a first and a second end. Attached to the second end is a housing. A first magnet is secured to the first end and a second magnet is positioned within the housing. In operation, the user of the magnet sweep moves the housing along a surface to attract metal particles thereon. Securing the first magnet to the first end allows the user of the magnet sweep to attract metal particles present on tough to reach surfaces, e.g., behind file cabinets, work benches, corners, et cetera, to the first magnet by manipulation of the member in areas where tough to reach surfaces exist.

In one aspect of the invention, the housing comprises a substantially rectangular chamber having a side walls and a hollow shaft which extends upwardly from the chamber. The second magnet is secured within the chamber and the first magnet is secured within a cavity formed in the first end. The second end is received in the hollow shaft and can be secured thereto by screws, rivets, adhesives, etc.

In one embodiment, the second magnet comprises a plurality of magnets disposed within the chamber. A metal plate is positioned over the magnets and secured to the chamber with threaded fasteners.

In yet another aspect of the invention, the member comprises a pole. The first magnet can be secured within the cavity by gluing the magnet in the cavity and the second magnet can be secured to the housing by screws, rivets, adhesives, etc.

In another aspect of the invention, the housing comprises a chamber and a shaft extending upwardly therefrom. The shaft is pivotally attached to the chamber. Alternatively, the shaft can be rotatably attached to the base. The second magnet is secured within the chamber and the second end is received in the shaft.

In yet another aspect of the invention, the housing comprises a chamber having a grooved rear and front side, a post integral with the chamber and a slide that includes front, rear and bottom portions. The front and rear portions each include a projection. The projection of the front end is received in the groove of the front side and the projection of the rear portion is received in the groove of the rear side thereby fitting the slide to the base. The second magnet is secured within the chamber by positioning a metal plate over the second magnet and connecting the metal plate to the chamber. In operation, the user of the magnet sweep moves the now magnetized metal plate along a surface, e.g., a floor, to attract metal particles present on the floor to the magnetized metal plate. To remove the attracted particles from the magnetized metal plate, the user can then move the slide along the length of the chamber, the sides of the bottom portion knocking of the attracted particles from the magnetized metal plate.

In another aspect of the invention, the member is collapsible to allow for easy storage. For example, the member can be jointed to allow the folding thereof.

In yet another aspect of the invention, the member comprises a telescoping member that allows the member to collapse for easy storage.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
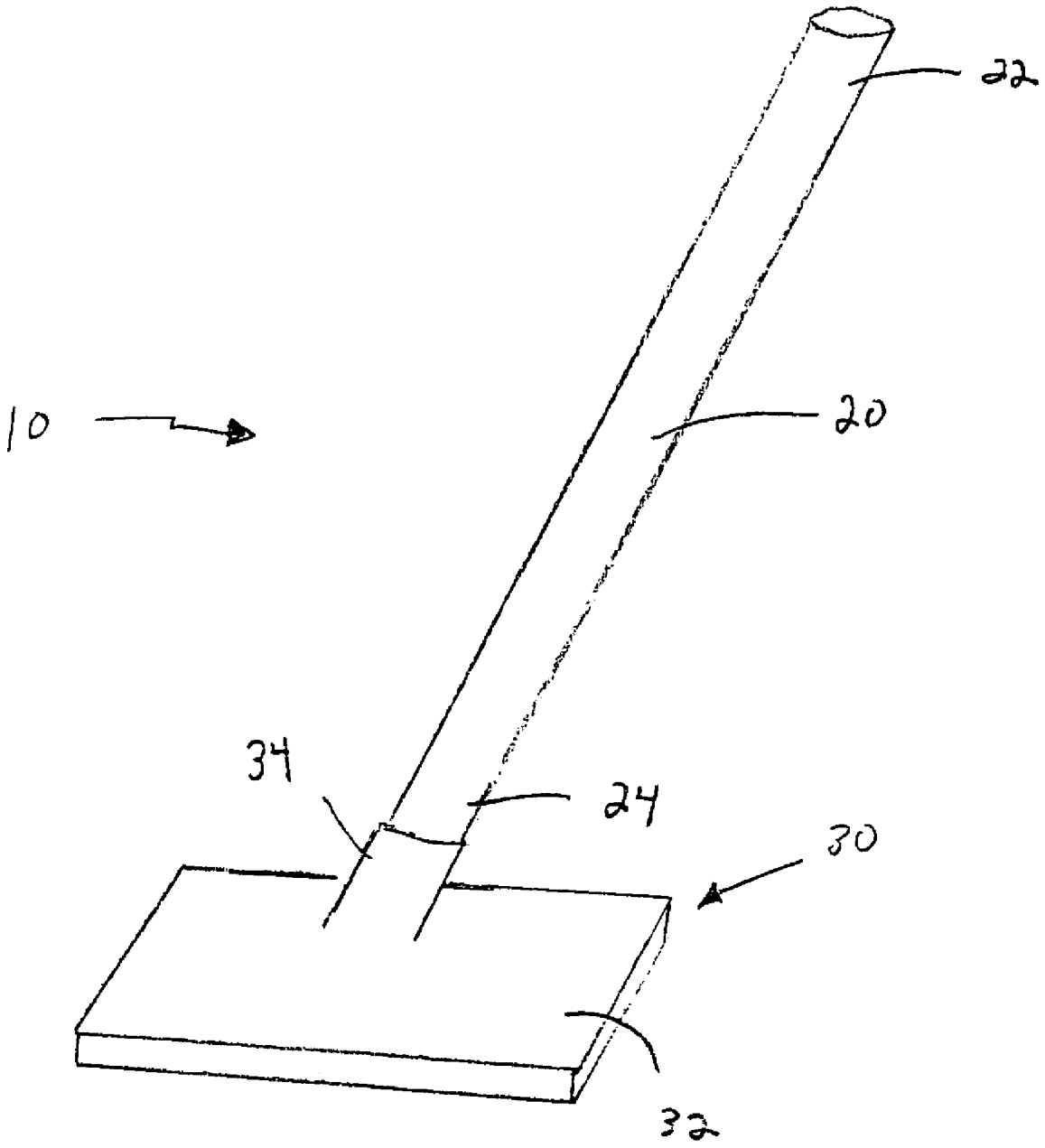
FIG. 1 is a perspective view of a magnet sweep.

FIG. 1 is a perspective view of a magnet sweep 10. The magnet sweep 10 comprises a longitudinal member 20, e.g., a pole, having a first end 22 and a second end 24 and a housing 30 which is connected to the second end 24. The longitudinal member 20 can be constructed of wood, plastic, wood/plastic composites, metals, etc., and the housing 30 can be constructed from plastic, wood, wood/plastic composites, etcetera.

Figure 2:
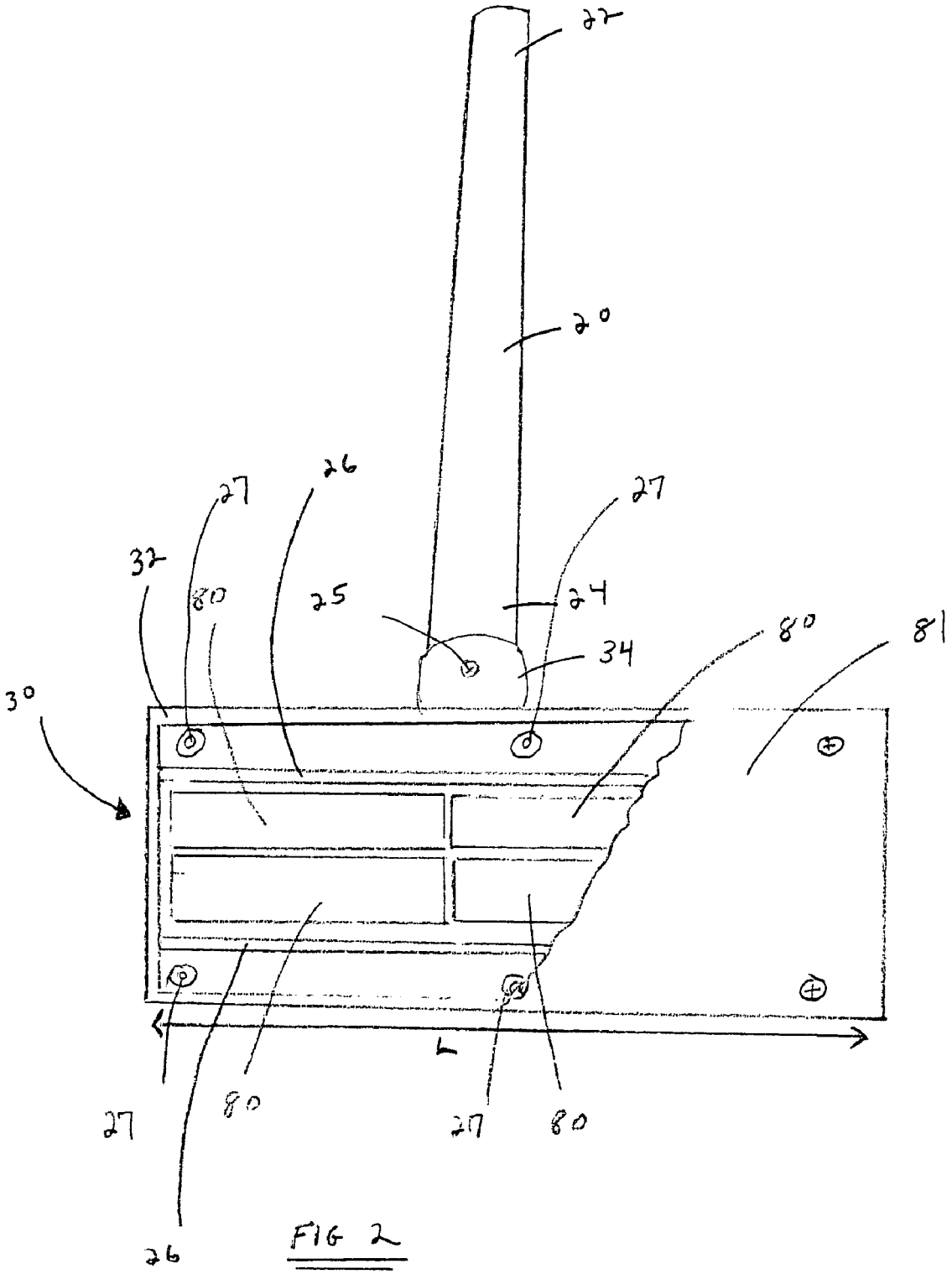
FIG. 2 is a partial bottom cut-a-way view of FIG. 1.

FIG. 2 is a partial top cross-section view of FIG. 1. Referring to FIGS. 1 and 2, the housing 30 can be constructed of plastic and comprises a chamber 32 and an extension 34. The extension 34 is secured to the chamber 32 by a fastener 25. A cylindrical magnet (not shown) is disposed within the first end 22 and a plurality of magnets 80 are disposed within the chamber 32.

The plurality of magnets 80 are frictionally fitted within the chamber 32 between longitudinal barriers 26. Each longitudinal barrier 26 extends along the length L of the chamber 32. Six threaded tubes 27 (only 4 shown) are integrally disposed within the chamber 32. A metal plate 81 having six tubes 82 (only 2 shown) is positioned over the magnets 80. The metal plate 81 is positioned over the magnets 80 such that the bores 82 are aligned in registration with the six threaded tubes 27. The metal plate 81 is secured to the chamber 32 by threading a fastener into each bore 82 and down into the aligned tube 27.

Figure 3:
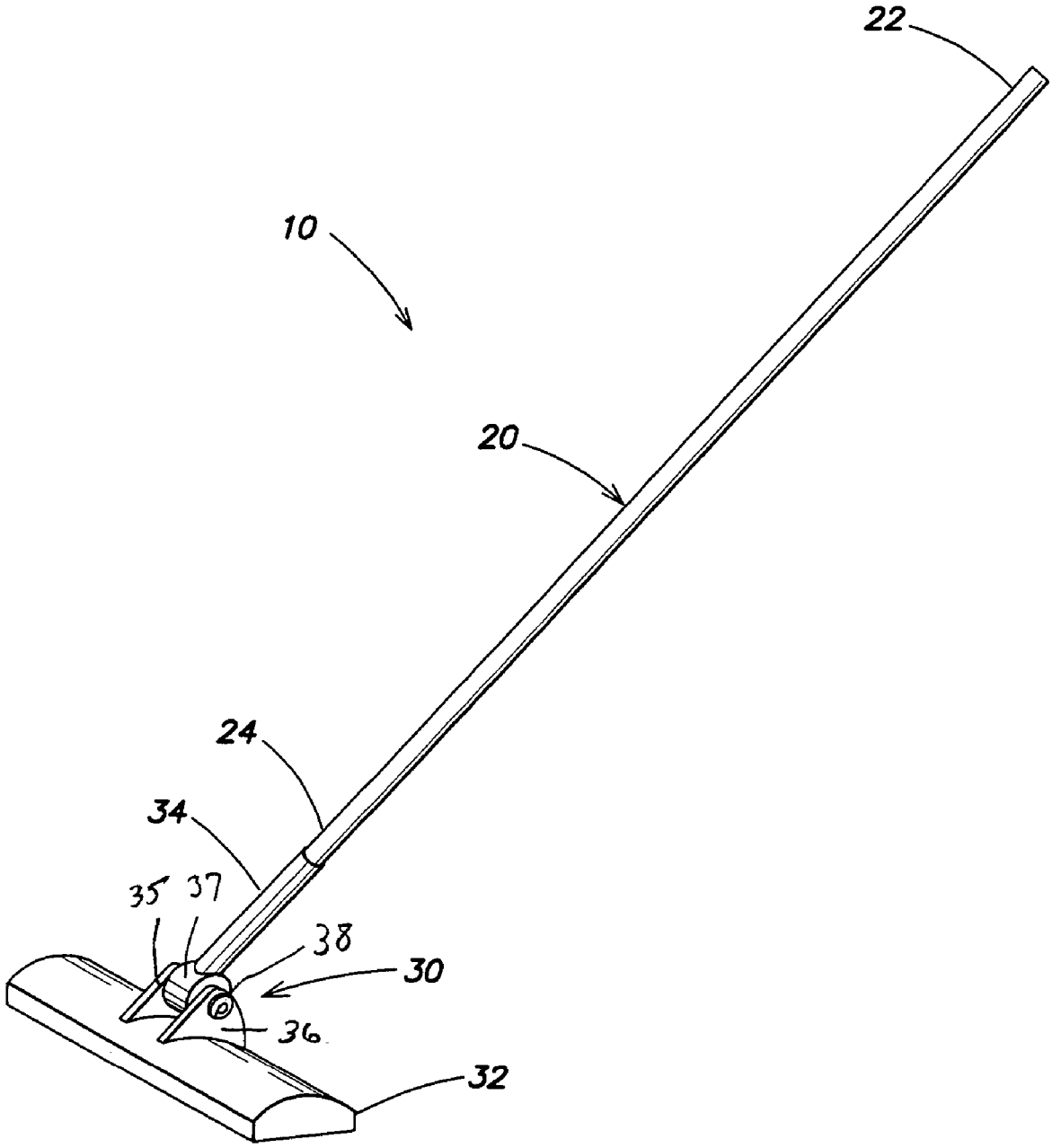
FIG. 3 is a perspective view of an alternative embodiment of FIG. 1.

FIG. 3 is a perspective view of an alternative embodiment of FIG. 1. The chamber 32 comprises a first post 35 and a second post 36 and the extension 34. The extension 34 includes a knob 37. The knob 37 is disposed between the first post 35 and the second post 36 and is pivotally secured to the chamber 32 with a fastener (e.g., screws, rivets) 38.

Figure 4:
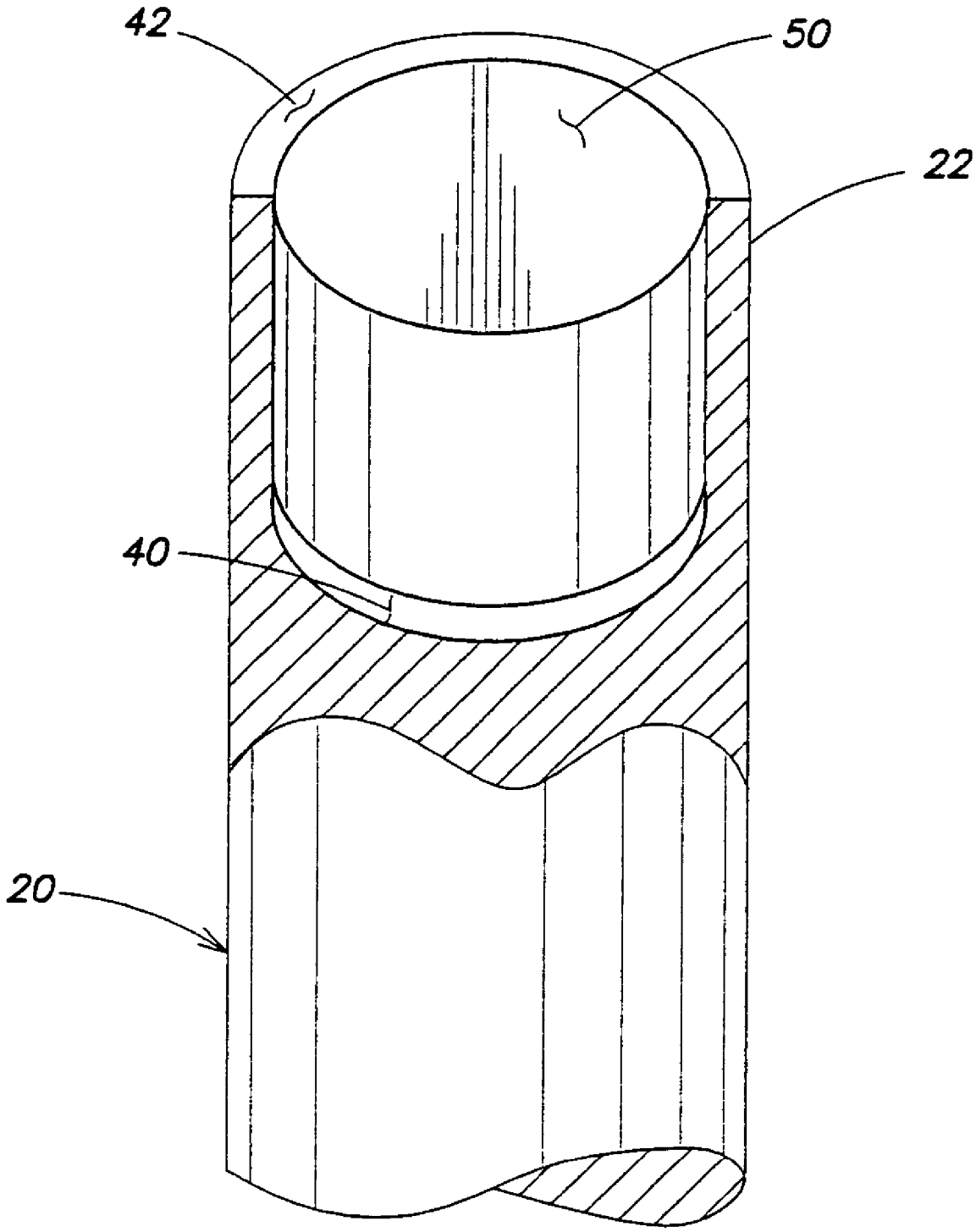
FIG. 4 is a partial cross-sectional view of FIG. 1.

FIG. 4 is a partial cross-sectional view of FIG. 1. The first end 22 has a cavity 40 formed by an edge 42. Positioned within the cavity 40 is a cylindrical magnet 50. The cylindrical magnet 50 is secured within the cavity with an adhesive. The surface of the cylindrical magnet 50 is preferably flush with the edge 42. In another embodiment, at least a portion of the cylindrical magnet can extend above the edge 42.

Figure 5:
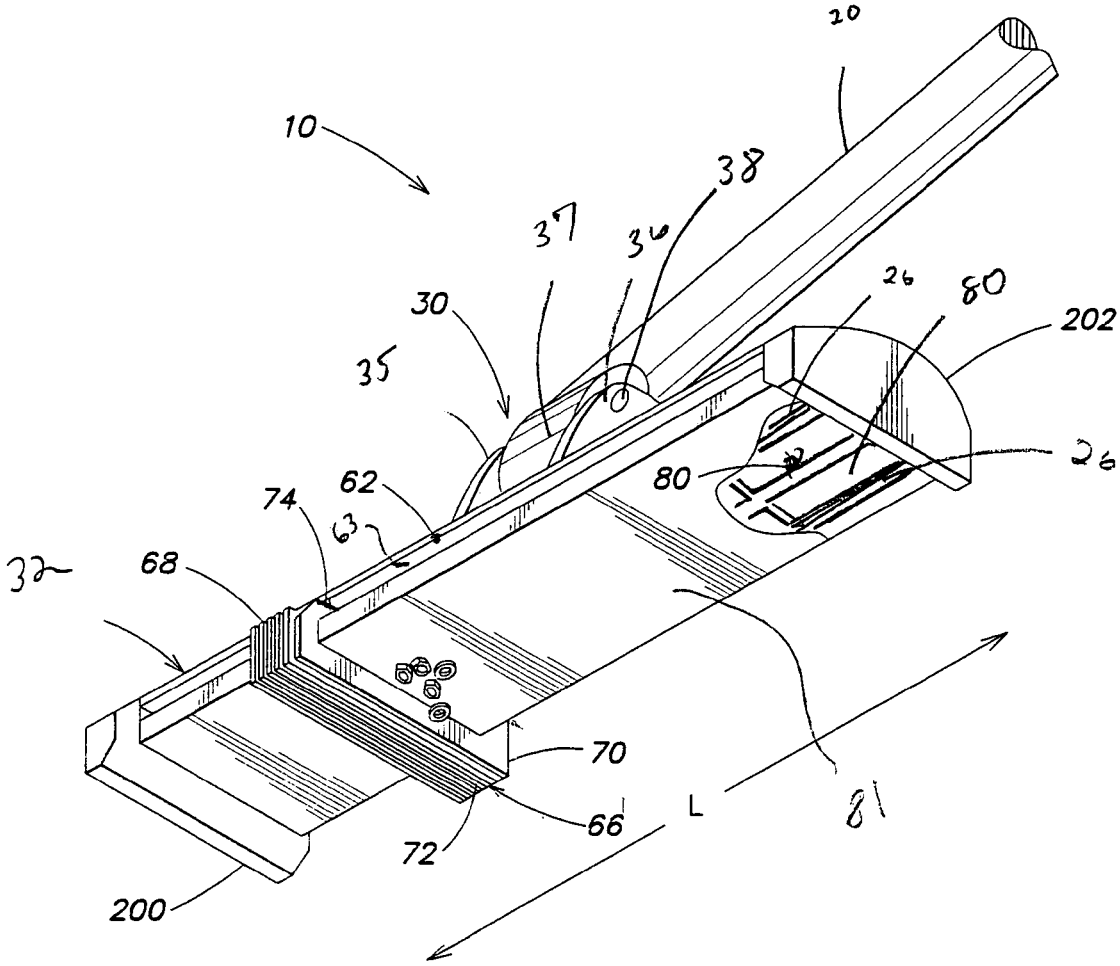
FIG. 5 is a partial perspective view of an alternative embodiment of FIG. 1.

FIG. 5 is a partial perspective view of an alternative embodiment of FIG. 1. The housing 30 includes a slide or cleaning member 66 which includes a front portion 68, a rear portion 70 and a bottom portion 72. The slide can be constructed of plastic, wood, composites, et cetera. The front 68 and rear 70 portions each include a projection 74 (only one shown).

The chamber 32 has a rear side (not shown), a front side 62, a first end wall 200 and a second end wall 202. End walls 200 and 202 project beyond metal plate 81 and function in part as stops disposed at opposite ends of the plate to limit a range of motion of slide or cleaning member 66 along the plate. The rear side and the front side 62 each have a groove 63 (only one shown) disposed therein. The slide 66 is slidably secured to the chamber 32 by inserting the projection 74 of the front portion 68 in the groove 63 of the front side 62 and inserting the projection (not shown) of the rear portion (not shown) in the groove of the rear side (not shown). In operation, the user of the magnet sweep 10 moves the chamber 32 along a surface, e.g., a floor, to attract any metal particles, e.g., staples, bolts, nuts, etc., present on the floor to the metal plate 81. The magnets 80 attract the metal particles to the metal plate 81. The user by hand can then move the slide 66 along the length L of the chamber 32, along and adjacent to the metal plate 81, in the either direction indicated by the arrows to remove the particles attracted to the metal plate 81. In confronted with metal particles present on a work surface in a tough reach area, the user manipulates the longitudinal member 20 in such a way to attract the metal particles to the magnet (not shown) secured to the first end (not shown) of the longitudinal member 20.

Figure 6:
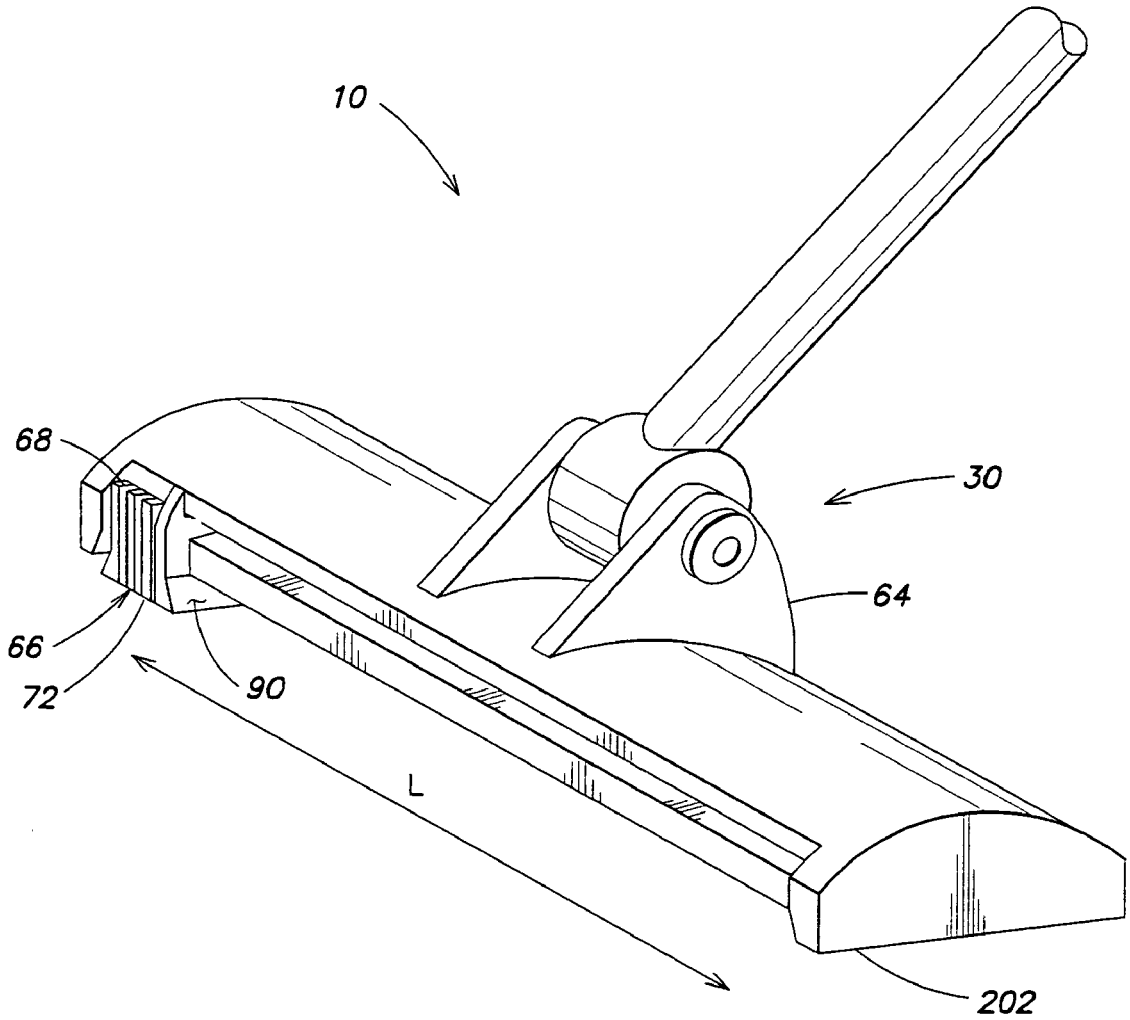
FIG. 6 is a partial perspective view of an alternative embodiment of FIG. 5.

FIG. 6 is a partial perspective view of an alternative embodiment of FIG. 5. The bottom portion 72 has a first side wall 90 and second side wall (not shown). The first side wall 90 and the second side wall (not shown) angularly extend from the bottom portion 72 toward the metal plate 81 to facilitate the removal of attracted metal particles when the slide 66 is moved by hand along length L.

Figure 7:
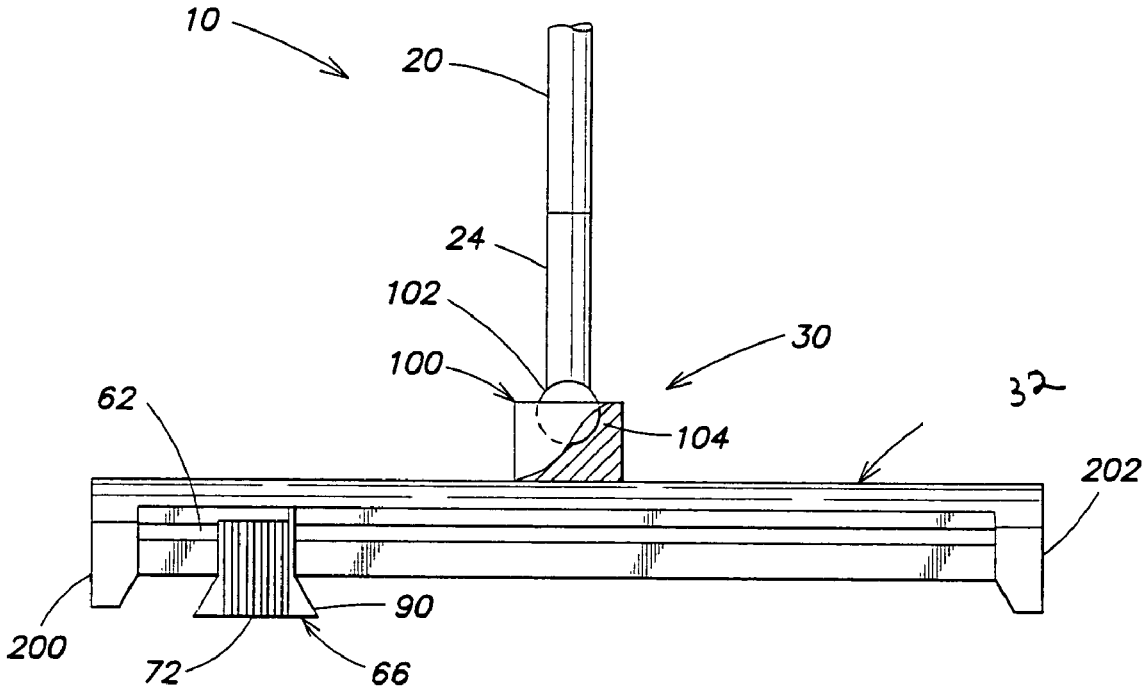
FIG. 7 is a partial front view of an alternative embodiment of FIG. 6.

FIG. 7 is a partial front view of an alternative embodiment of FIG. 6. In this embodiment, a shaft 100 extends upwardly from said chamber 32. The second end 24 of the longitudinal member 20 is comprised of a knob 102. The interior of the chamber 104 is configured to mate with at least a portion of the knob 102. The knob 102 is snap-fitted into the interior of the chamber 104 to rotatably connect the pole 20 to the base 60.

Although the present invention has been shown and described with a preferred embodiment thereof, various changes, omissions and additions to the form and detail thereof, may be made therein, without departing from the spirit and scope of the invention.

What is claimed is:

1. A device for attracting metal particles which comprises:

a longitudinal member having a first and second end;

a housing connected to said second end and being substantially perpendicular to said longitudinal member, said housing having a magnet disposed therein;

a plate having a surface area secured to said housing and positioned within a proximity to said magnet to magnetize said plate, said surface area of said plate having a larger area than said surface of said magnet; and a cleaning member slidably mounted to said housing adjacent to said plate, said cleaning member being movable along and adjacent to said plate, for detaching from said plate metal pieces magnetically attracted thereto, at least one of said housing and said cleaning member being provided with a groove, the other of said housing and said cleaning member being provided with at least one protuberance or projection extending into said groove.

2. The device of claim 1 wherein said housing is pivotally connected to said second end.

3. The device of claim 1 wherein said housing is rotatably connected to said second end.

4. The device of claim 1 wherein said housing is fixedly connected to said second end, said magnet is positioned within said housing and said longitudinal member is cylindrical.

5. The device of claim 1 wherein said first end has a cavity, said cavity having an outer edge.

6. The device of claim 1 wherein said housing is provided with a pair of parallel grooves, said cleaning member including protuberances or projections extending into said grooves.

7. The device of claim 1 wherein said cleaning member has a pair of opposing side walls oriented at acute angles relative to said plate.

8. A magnet sweep which comprises:

a longitudinal member having a distal and proximal end;

a housing secured to said proximal end and being substantially perpendicular to said longitudinal member, said housing comprised of a chamber, said chamber having a length L, a front side having a groove disposed therein, a rear side having a groove disposed therein, a first end wall and a second end wall;

a first magnet secured to said distal end, said first magnet having a surface;

a second magnet secured within said chamber;

a plate having a surface area secured to said chamber and positioned within a proximity to said second magnet to magnetize said plate, said surface area of said plate having a substantially larger square area than said surface of said first magnet; and a slide having front, rear and bottom portions, said front and rear portions each having a projection, said projection of said front portion being received in said groove of said front side and said projection of said rear portion being received in said groove of said rear side to slidably connect said slide to said housing, said bottom portion having a first and second edge, said first edge detaching metal pieces attracted to said surface of said second magnet when moved along length L of said housing in a direction toward said second end wall and said second edge detaching metal pieces attracted to said surface of said second magnet when moved along length L of said housing in a direction toward said first end wall.

9. The sweep of claim 8 wherein said housing further comprises a post integral with said base, said post being adapted to receive said second end.

10. The sweep of claim 8 wherein said housing is pivotally connected to said second end.

11. The sweep of claim 8 wherein said distal end has a cavity, said cavity having an outer edge.

12. The sweep of claim 11 wherein said first magnet is positioned within said cavity.

13. The sweep of claim 12 wherein said at least a portion of said surface of said first magnet extends above said outer edge.

14. The sweep of claim 12 wherein at least a portion of said surface of said first magnet is flush with said outer edge.

15. A device for attracting metal particles which comprises:

a longitudinal member having a distal and proximal end;

a first magnet secured to said distal end, said first magnet having a surface;

a housing secured to said proximal end, said housing comprised of a front side having a groove disposed therein, a rear side having a groove disposed therein, a first wall and a second wall;

a second magnet secured to said housing, said second magnet having a surface, said surface of said second magnet having a square area that is substantially greater than said surface of said first magnet;

a plate having a surface area secured to said housing and positioned within a proximity to said second magnet to magnetize said plate, said surface area of said plate having a substantially larger square area than said surface of said first magnet; and a substantially U-shaped portion comprised of a first end wall having a protuberance extending therefrom, a second end wall having a protuberance extending therefrom and a cross member having a bottom surface, a first side wall angled acutely with respect to the X-axis of said bottom surface and a second side wall angled acutely with respect to the X-axis of said bottom, said protuberance of said first end wall being received in said groove of said front side and said protuberance of said second end wall being received in said groove of said rear side to slidably connect said U-shaped portion to said housing, said first side wall detaching metal pieces attracted on said surface of said second magnet when moved along length L of said housing in a direction toward said first side wall and said second side wall detaching metal pieces attracted on said surface of said second magnet when moved along length L of said housing in a direction toward said second side wall.

16. The device of claim 15 wherein said housing further comprises a chamber extending upwardly from said housing and wherein said longitudinal member comprises a shaft and said proximal end comprises a knob, said knob being received in said chamber to rotatably secure said longitudinal member to said housing.

17. The device of claim 15 wherein said distal end has a cavity, said cavity having an outer edge.

18. The device of claim 17 wherein said first magnet is positioned within said cavity.

19. The device of claim 18 wherein at least a portion of said surface of said first magnet is flush with said outer edge.

20. A device for attracting metal particles, comprising:

a longitudinal member having a first and second end;

a housing connected to said second end and being substantially perpendicular to said longitudinal member, said housing having a magnet disposed therein;

a plate secured to said housing and positioned within a proximity to said magnet to magnetize said plate, said plate having a surface with a larger area than the surface of said magnet; and a cleaning member slidably mounted to said housing adjacent to said plate, said cleaning member being movable along and adjacent to said plate, for detaching from said plate metal pieces magnetically attracted thereto, said housing having a pair of stops disposed at opposite ends of said plate to limit a range of motion of said cleaning member along said plate, said stops being end walls of said housing.

* * * * *